US007372401B2

(12) United States Patent
Outwater

(10) Patent No.: US 7,372,401 B2
(45) Date of Patent: May 13, 2008

(54) MULTITRACKING OF COLLOCATED SATELLITES

(75) Inventor: Jeffrey E. Outwater, Agoura Hills, CA (US)

(73) Assignee: The Boeing Company, Chicago, IL (US)

( * ) Notice: Subject to any disclaimer, the term of this patent is extended or adjusted under 35 U.S.C. 154(b) by 187 days.

(21) Appl. No.: 11/555,659

(22) Filed: Nov. 1, 2006

(65) Prior Publication Data

US 2007/0139266 A1 Jun. 21, 2007

Related U.S. Application Data

(60) Provisional application No. 60/597,622, filed on Dec. 13, 2005.

(51) Int. Cl.
*H01Q 3/00* (2006.01)

(52) U.S. Cl. ..... 342/359; 342/427

(58) Field of Classification Search ..... 342/75–76, 342/359, 424, 427; 343/754, 757
See application file for complete search history.

(56) References Cited

U.S. PATENT DOCUMENTS 4,725,843 A * 2/1988 Suzuki et al. ..... 342/359
4,841,303 A * 6/1989 Anderson ..... 342/359
5,175,556 A * 12/1992 Berkowitz ..... 342/354
5,764,185 A * 6/1998 Fukushima et al. ..... 342/359
2003/0043071 A1* 3/2003 Lilly et al. ..... 342/368
2006/0262013 A1* 11/2006 Shiroma et al. ..... 342/370

* cited by examiner

*Primary Examiner*—Dao Phan
(74) *Attorney, Agent, or Firm*—Felix L. Fischer

(57) ABSTRACT

Tracking of collocated satellites is accomplished by providing a single tracking antenna having a tracking feed and combiner which receives a first satellite signal. A first pointing error signal is extracted from the tracking feed based on the first satellite signal and the antenna is steered to a pointing angle to minimize the first pointing error signal. A second satellite signal is received and a second pointing error signal is extracted from the tracking feed based on the second satellite signal. An offset angle for the second satellite is then calculated from the second pointing error signal relative to the pointing angle of the antenna. Orbit estimation and can then be accomplished for the second satellite based on the offset angle directly or by conversion to an absolute angle.

18 Claims, 5 Drawing Sheets

MULTITRACKING OF COLLOCATED SATELLITES

REFERENCE TO RELATED APPLICATIONS

This application claims priority of U.S. Provisional Application Ser. No. 60/597,622 filed on Dec. 13, 2005 having the same title as the present application.

BACKGROUND OF THE INVENTION

1. Field of the Invention

The present invention relates to antenna tracking systems for satellites and more particularly for a method and apparatus for tracking of multiple satellites using a single antenna.

2. Description of the Related Art

Satellite orbit estimation generally uses measurements made from one or more ground stations to determine the satellite orbit. These measurements include range from the ground station to the satellite, and the line-of-sight angles (typically Azimuth and Elevation) from the ground station antenna to the satellite. The preferred method for accurate angle measurement uses a monopulse or pseudo-monopulse tracking system that keeps the ground antenna pointed at a specific satellite using a signal transmitted by the satellite being tracked.

In the case of two or more collocated satellites, satellites located in close proximity defined by approximately ±0.05° of longitude, it may be possible to measure the range to each of the satellites but the ground antenna and its tracking system can be configured to provide Azimuth/Elevation angles for only one of the satellites at a time. The other satellites are generally within the ground antenna beam pattern and a single ground antenna can be used to transmit and receive signals to/from these other satellites but the line-of-sight angles to the other satellites cannot be measured from the single ground antenna.

Currently, the primary methods to address this problem include using multiple ground antennas (one per collocated satellite) to provide the angle data or time sharing a single antenna by tracking each of the collocated satellites in sequence.

These current methods are not advantageous for several reasons. Ground antennas with monopulse tracking are expensive to purchase and to maintain. In some cases there is not enough room at the earth station site for multiple antennas. There is also a requirement for accurate calibration of the tracking systems of the different antennas relative to one another—relative errors in the angle measurements for the different satellites can have a negative effect on the resulting orbit estimation accuracy. Similarly, time sharing a single antenna adds operational complexity and requires the tracking receiver to be retuned to a unique frequency for each collocated satellite. There is a possibility of error in identification of the resulting measurements and the possibility of pointing the ground antenna away from any of the satellites.

It is therefore desirable to provide a method and apparatus for using a single antenna for tracking of multiple substantially collocated satellites without requiring the complexities of time sharing.

It is also desirable that the method and apparatus provided be capable of retrofit to existing antenna stations.

SUMMARY OF THE INVENTION

Tracking of collocated satellites is accomplished using a system employing the present invention by providing a single tracking antenna having at least one tracking feed and combiner which receives a first satellite signal. A first pointing error signal is extracted from the tracking feed based on the first satellite signal and the antenna is steered to a pointing angle to minimize the first pointing error signal. A second satellite signal is received and a second pointing error signal is extracted from the tracking feed based on the second satellite signal. An offset angle for the second satellite is then calculated from the second pointing error signal relative to the pointing angle of the antenna.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1A:
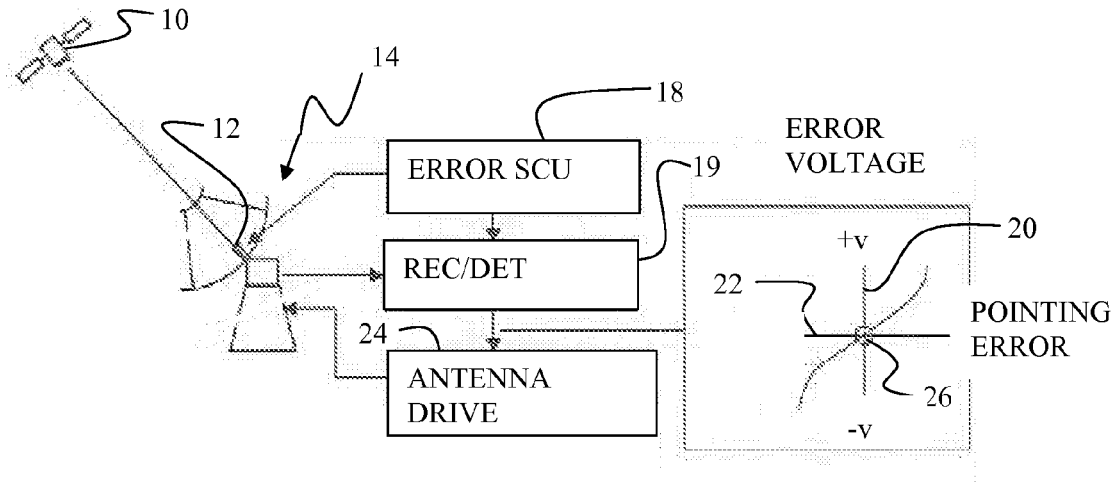
FIG. 1a (PRIOR ART)
FIG. 1*a* is a block diagram of prior art monopulse or pseudo-monopulse satellite tracking systems.

To better understand the embodiment of the invention disclosed herein, FIG. 1*a* discloses the basic elements of a monopulse tracking system as known in the art. A signal (typically a telemetry beacon but other signals are acceptable) is received from a satellite 10 by the monopulse tracking feed 12 on the ground antenna 14. This feed produces a radio frequency (RF) pointing error signal for each of the two pointing angles: Azimuth and Elevation. Each satellite has its own signal, at a unique frequency, that is suitable for tracking.

Figure 1B:
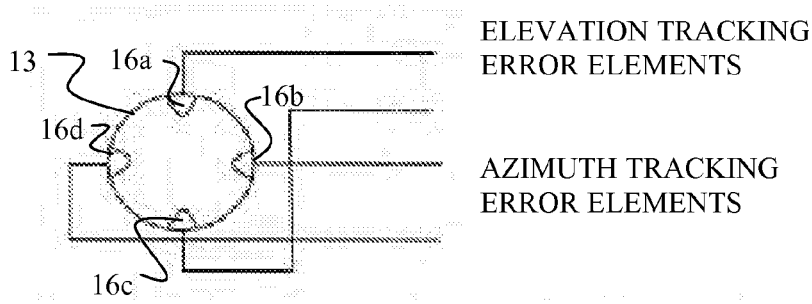
FIG. 1b (PRIOR ART)
FIG. 1*b* is a detailed diagram of the monopulse feed.

A representation of the monopulse feed is shown in FIG. 1*b*. Four small or ancilliary tracking feeds 16*a*, 16*b*, 16*c* and 16*d* are provided, as part of the main feed 13. In certain embodiments, the ancilliary tracking feeds are implemented as wave guide modes in the main feed. Tracking feeds 16*a* and 16*c* are combined provide an Elevation error signal (El error) respectively while feeds 16*b* and 16*d* similarly provide Azimuth error (Az error). A sum signal is derived from the four tracking feeds or from the main feed. Pseudomonopulse systems combine the error signals into a single signal to the tracking receiver combined with the sum signal. For purposes of systems employing the present invention as subsequently described, either monopulse or Pseudomonopulse systems are equivalent for the purposes of the invention as are different arrangements or implementations of the small tracking feeds.

Sampling control unit 18 generates a signal to the tracking feed/combiner that switches its output among the signals Sum+Az error, Sum+El error, Sum−Az error and Sum−El error. Each signal is sampled for a few milliseconds and the sampling sequence repeats indefinitely. The output is sent to the receiver/detector 19.

Figure 2:
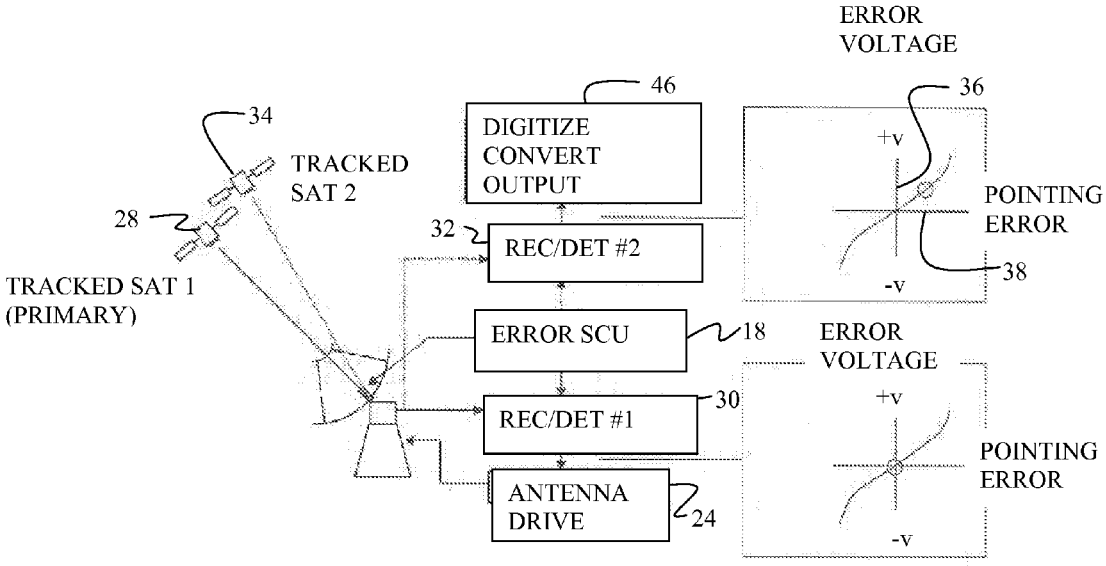
FIG. 2 is a block diagram schematically demonstrating the elements of the method and apparatus of one embodiment of the present invention.

The tracking receiver including associated downconverters, sampling electronics and demodulators receives the signal from the satellite and the output from the sampling control unit. It then separates the four components, using the signal from the sampling control unit for synchronization. It then recovers the sum and Azimuth and Elevation error signals, normalizes the error signals to the sum signal and outputs azimuth and elevation pointing error voltages, converting the RF error signal into an error voltage 20 representative of the angle position error 22 as shown in FIG. 1*a*, which is then input to the antenna drive system 24. The antenna drive system steers the ground antenna in the direction that reduces the pointing error voltage. FIGS. 1*a* and 2 use a single error voltage curve to depict either the Azimuth or Elevation error voltage. It is to be understood that both Azimuth and Elevation errors exist independently and are each treated in the same way.

The net effect of the control system is to keep the ground antenna pointed at the satellite being tracked by keeping the error signal within a value boundary represented by circle 26 shown in the plot of error voltage vs. angle position error. The actual pointing angles are sensed within the antenna control system, for example by Azimuth and Elevation shaft encoders, and are made available to external orbit estimation software.

The present invention provides a method for tracking on one of the substantially collocated satellites while concurrently making accurate measurements of the relative line-of-sight angles to one or more collocated satellites. The actual pointing angles to these other satellites are readily computed by adding an offset based on pointing error of the collocated satellites to the actual antenna pointing angles. Extensions of this invention include the use of multiple tracking feeds on a single antenna to cover multiple frequency bands (e.g. 'C' and 'Ku').

With an initial calibration of a single ground antenna a system employing the present invention makes accurate (0.01 degrees or better) measurements of the relative lines-of-sight of multiple collocated satellites and converts these relative angles to absolute pointing angles. This can be achieved with a 'one time' setup of the tracking system.

The accuracy of the relative measurements is better than the absolute accuracy of the underlying conventional off the shelf (COTS) monopulse tracking system and the major errors, in the relative measurement, have a Gaussian distribution about a zero mean. Frequent sampling of the relative pointing angles allows the Gaussian errors to be reduced. The major sources of tracking error include calibration errors in the antenna boresight, non-linearities in the antenna pointing measurement, reflector distortions and other factors that generally affect all measurements made by a system employing the invention equally. As a result the relative line-of-sight measurements are significantly more accurate than any 'single satellite' measurement. This is particularly important in collocation orbit estimation where relative errors are more important than common biases.

The method of the present invention for tracking on one of the collocated satellites while concurrently measuring the relative line-of-sight angles to one or more collocated satellites is shown schematically in FIG. 2. Multiple tracking receivers (and possibly multiple tracking feeds) are provided, one of which is used to track a particular satellite 28 designated as 'Tracked Satellite #1'. The monopulse feed and tracking receiver 30 receives a signal from this satellite and produces the error voltages (Azimuth and Elevation) used to keep the ground antenna pointed at satellite #1 as described with respect to FIG. 1*a*.

Tracking receiver detector 32 is tuned to receive the pointing error signal from satellite 34, designated 'Satellite #2' in FIG. 2 using the unique RF signal from Satellite #2. Instead of using the tracking error voltages represented by error voltage 36 in FIG. 2 to control the ground antenna pointing, the error voltages are converted in digitizer 46 as a representation of pointing error 38 and converted to Azimuth and Elevation angle errors using a conversion table generated during antenna calibration. These angle errors represent offset angles for satellite #2 relative to the known antenna pointing angles for satellite #1. The orbit estimation process can use the relative angles or can convert them to absolute angles as appropriate.

Synchronization of receiver/detector #2 is achieved by providing a copy of the sampling control unit signal used by the feed and by receiver/detector #1 to receiver/detector #2.

Figure 3:
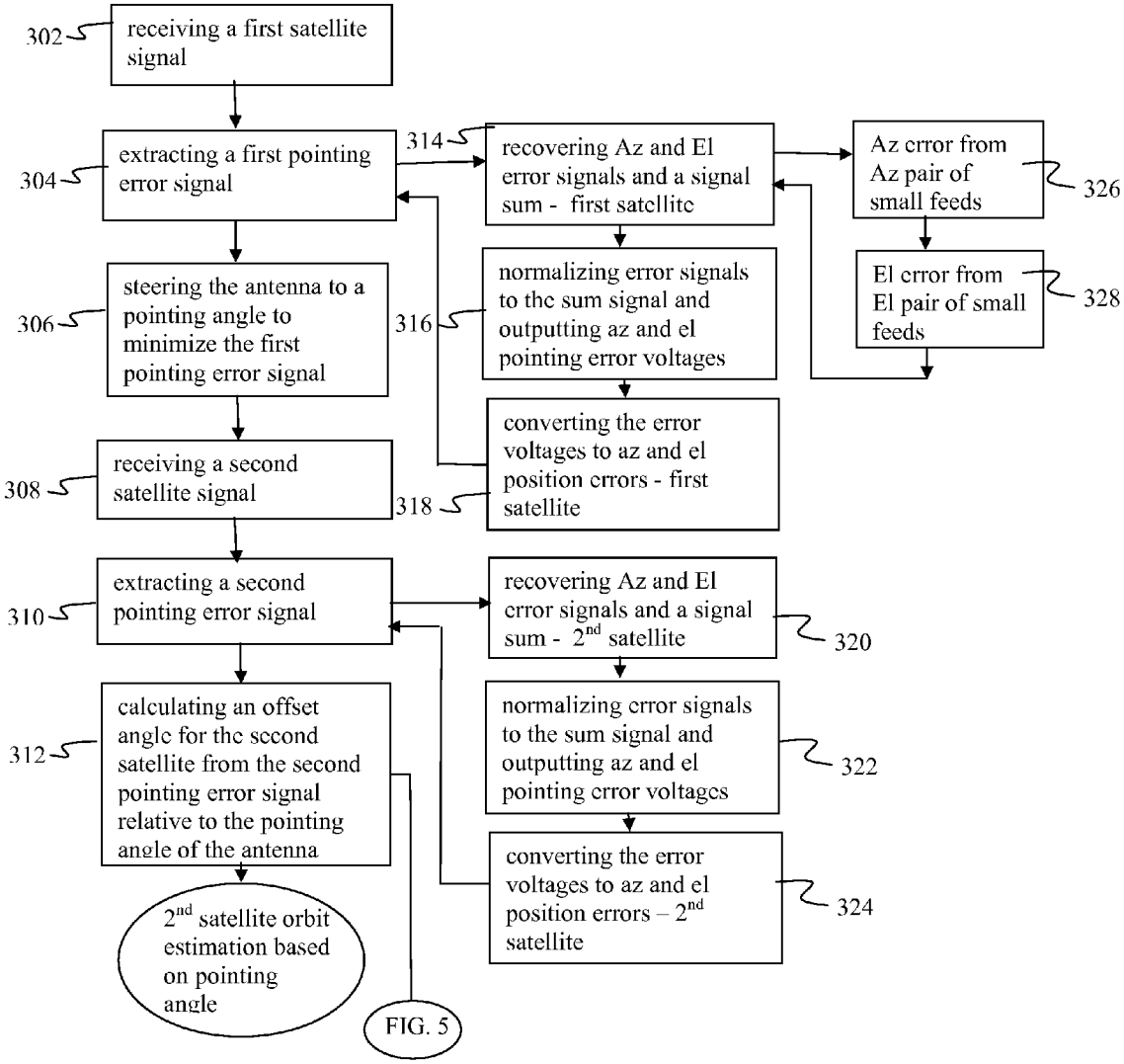
FIG. 3 is a flow chart of the elements of the method employed by one embodiment of the present invention.

The method of the invention is described in FIG. 3 wherein the first satellite signal is received 302 and a first pointing error signal is extracted 304 from the tracking feed based on the first satellite signal. The antenna is then steered 306 to a pointing angle to minimize the first pointing error signal. A second satellite signal is received 308 and a second pointing error signal is extracted 310 from the tracking feed based on the second satellite signal. An offset angle for the second satellite is calculated 312 from the second pointing error signal relative to the pointing angle of the antenna.

The step of extracting the first pointing error signal is accomplished by recovering Azimuth and Elevation error signals and a signal sum 314 for the first satellite with a first receiver/detector. The error signals are normalized to the sum signal and output as azimuth and elevation pointing error voltages 316 which are then converted to azimuth and elevation angle position errors for the first satellite 318.

Similarly, the step of extracting the second pointing error signal is accomplished by recovering Azimuth and Elevation error signals and a signal sum 320 for the second satellite with a second receiver/detector. The error signals are normalized to the sum signal and output as azimuth and elevation pointing error voltages 322 which are then converted to azimuth and elevation angle position errors for the second satellite 324.

The azimuth and elevation error voltages are obtained as described with respect to FIG. 1*b* using the four small tracking feeds by extracting Azimuth error (Az error) from the Azimuth pair (16*b* and 16*d*) of the small feeds 326 and extracting Elevation error (El error) from the Elevation pair (16*a* and 16*c*) of the small feeds 328.

Figure 4:
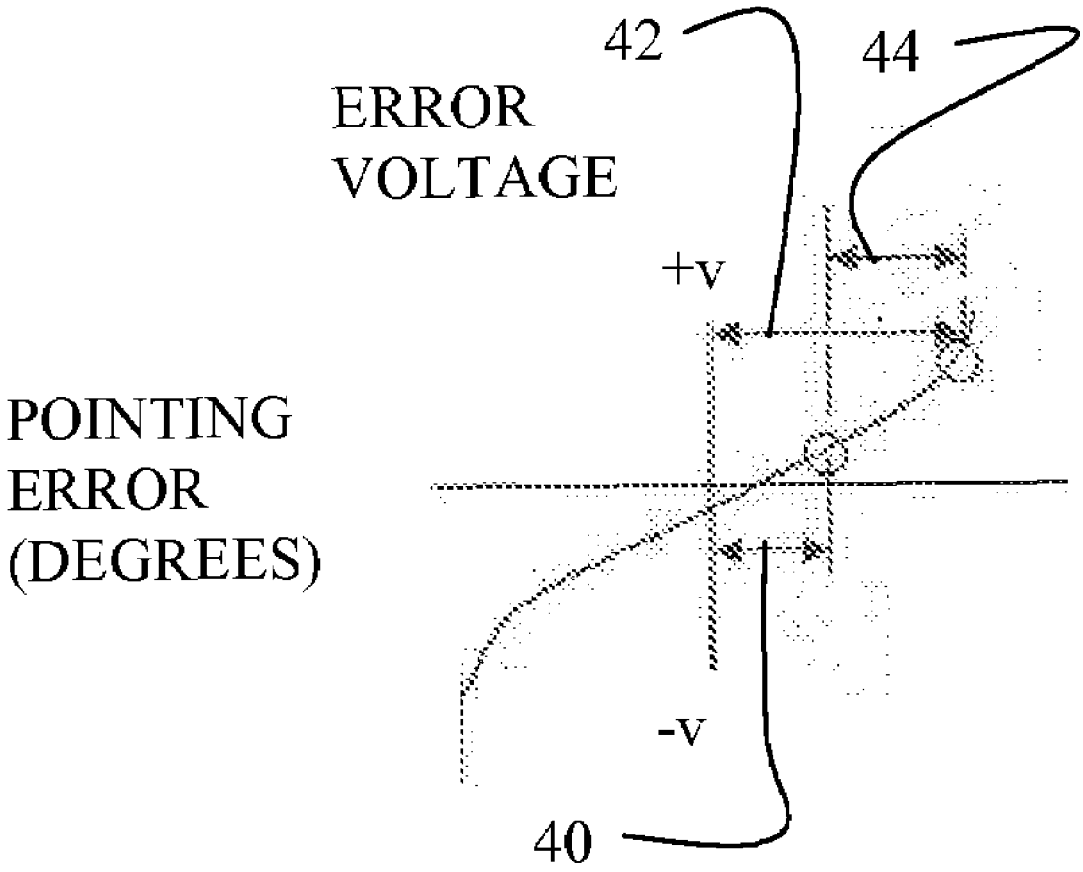
FIG. 4 is a detailed diagram of a correction method for tracking error in a system employing the present invention; and, FIG. 5 is a flow chart of the additional elements of the method employed by the present invention with the correction method of FIG. 4 incorporated.
Figure 5:
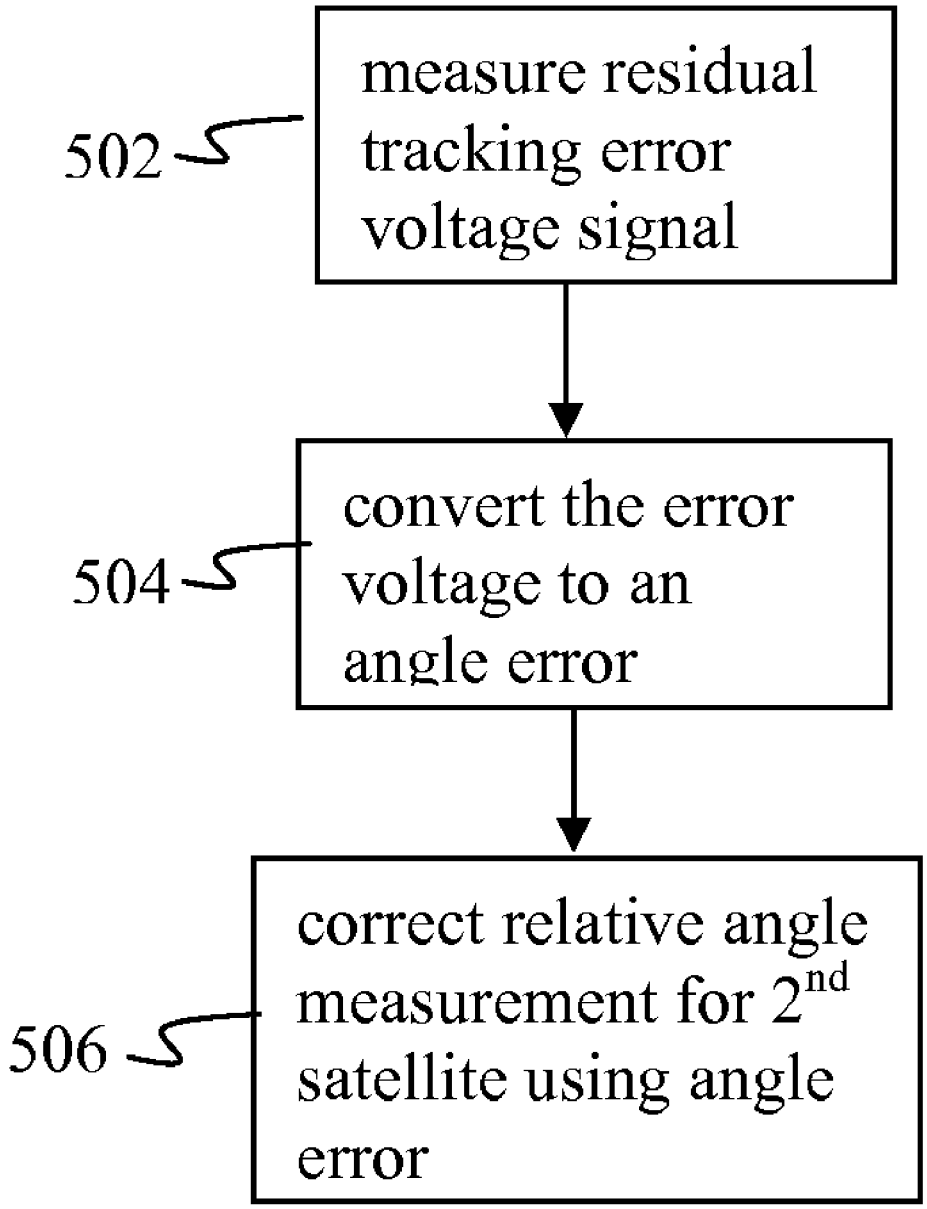

The relative line of sight measurements accomplished as described with respect to FIG. 2 above, assume that the mechanical response of the antenna is perfect in the sense that the tracking error voltage for Satellite #1 is kept to a small value with a zero mean. In some implementations this will not be the case. For example, the motion of the antenna may have a minimum step size and the antenna pointing will, on average, lag behind the true satellite motion. In such cases, the accuracy of the relative line of sight angle measurement for Satellite #2 (and others in larger multiple satellite configurations) may be improved by measuring the residual tracking error voltage signal from tracking receiver/detector #1. This error voltage is then converted to an angle error and used to correct the relative angle measurement. This process is illustrated in FIG. 4 with the method shown in the flow chart of FIG. 5 and applies to each of the Azimuth and Elevation angles measured.

The residual tracking error 40 for satellite #1 is measured from the output of tracking receiver and detector #1 as an angle position error voltage 502 and converted to an angle 504. This angle equals 0.0 degrees in the ideal case shown in FIG. 2. Satellite #2 line-of-sight angle is measured by the pointing error 42 relative to antenna pointing direction. This is the relative line-of-sight angle between the Satellite #1 and Satellite #2 in the ideal case where the residual tracking error for satellite #1 is zero. The actual difference in angle position error 44 of satellite #2 relative to Satellite #1 representing Satellite #2 line-of-sight angle relative to satellite #1 line-of-sight direction then provides the corrected angle input 506 for orbit estimation through a digitizer 46.

Additional receivers/detectors for any desired number of additional satellites or by reconfiguring receiver/detector #2 to tune to the tracking signals from the additional satellites in sequence, allows tracking of a larger number of satellites. For applications where multiple satellites operate in different frequency bands, additional tracking feeds and combiners are mounted on the antenna or on the primary feed to cover the additional frequency bands. Implementation of the secondary feed(s) is highly dependent on the specific antenna design and alternative embodiments of the invention employ frequency selective reflector surfaces to allow flexibility in locating the extra feed(s). Operation of the multiple feeds is comparable to that previously described. The resulting accuracy is dependent on the stability of the relative feed alignments over time and over changing environmental conditions.

The present invention provides a configuration and process for using COTS components in a new way to provide concurrent measurements of the line-of-sight angles to multiple satellites using a single ground antenna as described above. The configuration and process provides a high degree of accuracy in measuring relative angles by eliminating any tracking error sources that are common to all satellites being tracked. These include antenna alignment errors, reflector distortions (e.g. gravity caused), readout errors on the Azimuth and Elevation axes among others.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A method for tracking of collocated satellites comprising the steps of:

providing a single tracking antenna having at least one tracking feed and combiner;

receiving a first satellite signal;

extracting a first pointing error signal from the tracking feed based on the first satellite signal;

steering the antenna to a pointing angle to minimize the first pointing error signal;

receiving a second satellite signal;

extracting a second pointing error signal from the tracking feed based on the second satellite signal;

calculating an offset angle for the second satellite from the second pointing error signal relative to the pointing angle of the antenna.

2. A method as defined in claim 1 wherein the step of extracting the first pointing error signal comprises the steps of:

recovering Azimuth and Elevation error signals and a signal sum for the first satellite with a first receiver/detector;

normalizing the error signals to the sum signal and outputting azimuth and elevation pointing error voltages;

converting the error voltages to azimuth and elevation position errors for the first satellite.

3. A method as defined in claim 2 wherein the step of extracting the second pointing error signal comprises the steps of:

recovering Azimuth and Elevation error signals and a signal sum for the second satellite with a second receiver/detector;

normalizing the error signals to the sum signal and outputting azimuth and elevation pointing error voltages;

converting the error voltages to azimuth and elevation angle position errors for the second satellite.

4. A method as defined in claim 2 wherein the step of recovering azimuth and elevation error signals comprises the steps of:

providing four tracking feeds;

extracting positive Azimuth error (+Az error) from a first one of the feeds;

extracting positive Elevation error (+El error) from a second one of the feeds;

extracting negative Azimuth error (−Az error) from a third one of the feeds; and, extracting negative Elevation error (−El error) from the forth feed.

5. A method as defined in claim 4 wherein the sum signal is derived from the four tracking feeds.

6. A method as defined in claim 2 further comprising the steps of:

measuring a residual tracking error voltage signal from the first receiver/detector;

converting the error voltage to an angle error;

using the angle error to correct the relative angle measurement for the second satellite.

7. A method as defined in claim 2 further comprising the step of estimating the orbit for the second satellite based on the offset angle.

8. A method as defined in claim 7 wherein the step of estimating the orbit further includes the step of converting the offset angle to an absolute pointing angle based on the antenna pointing angle.

9. A method for tracking of a plurality of collocated satellites comprising the steps of:

providing a single tracking antenna having at least one tracking feed and combiner;

receiving a first satellite signal;

extracting a first pointing error signal from the tracking feed based on the first satellite signal;

steering the antenna to a pointing angle to minimize the first pointing error signal;

receiving from each of a plurality of satellites a signal;

extracting a plurality of pointing error signals from the tracking feed based on and respective to each of the plurality of satellite signals;

calculating an offset angle for each of the plurality of satellites from the respective pointing error signals relative to the pointing angle of the antenna.

10. An apparatus for tracking of collocated satellites comprising:

a single tracking antenna having at least one tracking feed and combiner;

means connected to the at least one tracking feed for receiving a first satellite signal;

means for extracting a first pointing error signal from the tracking feed based on the first satellite signal;

means for steering the antenna responsive to the extracting means to a pointing angle to minimize the first pointing error signal;

means for receiving a second satellite signal connected to the tracking feed;

means for extracting a second pointing error signal from the tracking feed based on the second satellite signal;

means for calculating an offset angle for the second satellite from the second pointing error signal relative to the pointing angle of the antenna.

11. An apparatus for tracking of collocated satellites defined in claim 10 wherein the means for extracting the first pointing error signal comprises:

a first receiver/detector for recovering Azimuth and Elevation error signals and a signal sum for the first satellite;

means for normalizing the error signals to the sum signal and outputting azimuth and elevation pointing error voltages; and means for converting the error voltages to azimuth and elevation position errors for the first satellite.

12. An apparatus for tracking of collocated satellites defined in claim 11 wherein the means for extracting the second pointing error signal comprises:

a second receiver/detector for recovering Azimuth and Elevation error signals and a signal sum for the second satellite;

means for normalizing the error signals to the sum signal and outputting azimuth and elevation pointing error voltages;

means for converting the error voltages to azimuth and elevation position errors for the second satellite.

13. An apparatus for tracking of collocated satellites as defined in claim 11 further comprises:

four tracking feeds responsive to an error sampling control unit providing signals to the receiver/detector;

the error sampling control unit including means for extracting positive Azimuth error (+Az error) from a first one of the feeds;

means for extracting positive Elevation error (+El error) from a second one of the feeds;

means for extracting negative Azimuth error (−Az error) from a third one of the feeds; and, means for extracting negative Elevation error (−El error) from the forth feed.

14. An apparatus for tracking of collocated satellites as defined in claim 13 wherein the sum signal is derived from the four tracking feeds.

15. An apparatus for tracking of collocated satellites as defined in claim 11 further comprising:

means for measuring a residual tracking error voltage signal from the first receiver/detector;

means for converting the error voltage to an angle error; and, means using the angle error to correct the relative angle measurement for the second satellite.

16. An apparatus for tracking of collocated satellites as defined in claim 11 further comprising means for estimating the orbit for the second satellite based on the offset angle.

17. An apparatus for tracking of collocated satellites as defined in claim 16 wherein the means for estimating the orbit further includes means for converting the offset angle to an absolute pointing angle based on the antenna pointing angle.

18. An apparatus for tracking of collocated satellites comprising:

a single tracking antenna having at least one tracking feed and combiner;

a first receiver connected to the at least one tracking feed for receiving a first satellite signal;

an error signal sampling control unit extracting a first pointing error signal from the tracking feed based on the first satellite signal;

an antenna drive system for steering the antenna responsive to the extracting means to a pointing angle to minimize the first pointing error signal;

a second receiver connected to the tracking feed for receiving a second satellite signal;

said error signal sampling control unit extracting a second pointing error signal from the tracking feed based on the second satellite signal;

a calculator determining an offset angle for the second satellite from the second pointing error signal relative to the pointing angle of the antenna.

* * * * *